US009481488B2

(12) United States Patent
Lewis

(10) Patent No.: US 9,481,488 B2
(45) Date of Patent: Nov. 1, 2016

(54) PALLET ASSEMBLY AND A LID APPARATUS FOR THE PALLET ASSEMBLY

(71) Applicant: GM GLOBAL TECHNOLOGY OPERATIONS LLC, Detroit, MI (US)

(72) Inventor: Neal A. Lewis, Dearborn Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 14/633,527

(22) Filed: Feb. 27, 2015

(65) Prior Publication Data

US 2016/0251111 A1 Sep. 1, 2016

(51) Int. Cl.
*B65D 19/38* (2006.01)
*B65D 19/00* (2006.01)

(52) U.S. Cl.
CPC ..... *B65D 19/0004* (2013.01); *B65D 19/38* (2013.01); *B65D 2519/00318* (2013.01); *B65D 2519/00537* (2013.01); *B65D 2519/00711* (2013.01)

(58) Field of Classification Search
CPC ..... B65D 19/0004; B65D 19/0075; B65D 19/38; B65D 19/44; B65D 2519/00318; B65D 2519/00537; B65D 2519/00711; B65D 2519/00955; B65D 2519/00965; B65D 2519/0097
USPC ..... 206/386, 53.3, 55.1, 55.5, 56.1, 597, 206/600; 108/55.1, 55.5, 56.1
See application file for complete search history.

(56) References Cited

U.S. PATENT DOCUMENTS 2,647,287 A * 8/1953 Jones ..... E04B 1/34321 108/55.1
3,857,342 A * 12/1974 Johns ..... B65D 19/0075 108/53.3
6,149,004 A * 11/2000 Lapinski ..... B65D 71/0096 206/386
6,418,861 B1 * 7/2002 Flam ..... B65D 19/0059 108/56.1
7,007,802 B1 * 3/2006 Moorman et al. ..... B65D 5/22 206/386
7,360,493 B2 * 4/2008 Hummel et al. ... B65D 19/0097 108/53.3

FOREIGN PATENT DOCUMENTS

GB 807572 A * 1/1959 ..... B65D 19/0075

* cited by examiner

*Primary Examiner* — Bryon Gehman
(74) *Attorney, Agent, or Firm* — Quinn Law Group, PLLC

(57) ABSTRACT

A pallet assembly and a lid apparatus for the pallet assembly include a first lid segment and a second lid segment selectively cooperating with each other. The lid segments each include an outer edge and an inner edge spaced in an opposing relationship. The inner edges of the lid segments are configured to face each other. The first lid segment includes a first locking feature disposed proximal to the inner edge of the first lid segment and the second lid segment includes a second locking feature disposed proximal to the inner edge of the second lid segment. The lid segments are movable between an engaged position in which the locking features engage each other to secure the lid segments together to define a complete lid, and a disengaged position in which the locking features disengage from each other to separate the lid segments.

20 Claims, 3 Drawing Sheets

PALLET ASSEMBLY AND A LID APPARATUS FOR THE PALLET ASSEMBLY

TECHNICAL FIELD

The present disclosure relates to a pallet assembly and a lid apparatus for the pallet assembly.

BACKGROUND

Pallets can be used to stack a plurality of vehicle components thereon to transport those components to a desired location. Various vehicle components can be organized in bins and these bins can be stacked on top of a pallet. When the desired number of bins are stacked on the pallets, the bins at the top are open. To cover the bins that are disposed at the top, a lid is disposed over the tops of those bins.

Some lids that cover the top bins can be one single piece. For example, some of these single piece lids can be large, such as having a dimension of about 48 inches by 45 inches, which can be cumbersome to move due to the location of the center of gravity of the lid being quite a distance away from an operator. Furthermore, these one piece lids can be formed by vacuum molding and these vacuum formed lids can deflect outwardly away from the bins during use which can allow the vehicle components in the top bins to undesirably shift and/or allow fluids and/or contaminates to enter the top bins.

When stacking one pallet on top of another lid, some pallets can define a recessed area and the single piece lids can include an outwardly extending boss that cooperates with the recessed area. Therefore, when one pallet is stacked on top of one single piece lid, the boss of that lid is disposed in the recess area of that pallet to position the pallet and the lid relative to each other.

To assist moving these single piece lids, a pair of handles can be attached to the lids. However, these handles are attached with fasteners that create holes in the lids which can allow fluids and/or contaminates to enter the top bins. Alternatively, the handles can be built into the lid by cutting away some of the material of the lid with a cutting tool which creates holes that are handles. The operator can grasp these handle holes to move the lid. These handle holes in the lids can allow fluids and/or contaminates to enter the top bins.

Other lids have been designed as two pieces which are permanently hinged together. Therefore, the lid can fold in half about the hinges but these pieces cannot be separated as individual pieces. Therefore, moving these types of lids can be cumbersome since the operator is still moving one entire lid. Furthermore, these hinged lids can deflect at the hinge outwardly away from the bins during use which can allow the vehicle components in the top bins to undesirably shift and/or allow fluids and/or contaminates to enter the top bins.

To restrain the vehicle components in the top bins relative to the lid, some lids have been designed with an insert that is attached to a bottom side of the lids and the inserts hold the vehicle components in place. Therefore, certain lids with certain inserts are utilized for certain vehicle components so additional costs can be incurred to produce different lids for different purposes. Furthermore, different lids for different vehicle components requires the operator to choose the desired lid for that particular vehicle component which can be time consuming and/or an undesired lid could be chosen. Additionally, lids not being utilized for that particular vehicle component have to be stored which requires storage space. Alternatively, empty top bins can be utilized to hold the vehicle components in place in the below bins but this creates unused space.

To secure the lid relative to the bins, a pair of retractable belts can be utilized on opposing sides of the pallet and a corresponding pair of buckles can be utilized on opposing sides of the lid. One end of the belts are secured to the pallet and the buckles are secured to the lid, and when the belts engage respective buckles, the lid is coupled to the pallet, with the bins restrained therebetween. However, when the lid is secured with the belts and the buckles, opposing forces are applied to the lid which can cause the lid to deflect outwardly away from the bins, for example, at its center. Lid deflection can allow the vehicle components disposed in the top bins to undesirably shift even when utilizing the insert discussed above and/or allow fluids and/or contaminates to enter the top bins.

Other pallets have been designed with a leg coupled to each corner of the pallet to support a shelf stacked on the legs. Each corner of the pallet can define a through-hole. Each leg and the inside of each through-hole can include features that couple the legs to the respective corner of the pallet.

SUMMARY

The present disclosure provides a lid apparatus for a pallet assembly. The lid apparatus includes a first lid segment and a second lid segment selectively cooperating with each other. The first and second lid segments each include an outer edge and an inner edge spaced in an opposing relationship. The inner edge of the first lid segment and the inner edge of the second lid segment are configured to face each other. The first lid segment includes a first locking feature disposed proximal to the inner edge of the first lid segment and the second lid segment includes a second locking feature disposed proximal to the inner edge of the second lid segment. The first and second lid segments are movable between an engaged position in which the first and second locking features engage each other to secure the first and second lid segments together to define a complete lid, and a disengaged position in which the first and second locking features disengage from each other to separate the first and second lid segments.

The present disclosure also provides a pallet assembly that includes a base pallet and at least one bin stacked on the base pallet. The pallet assembly also includes a lid apparatus disposed on top of the bin. The lid apparatus includes a first lid segment and a second lid segment selectively cooperating with each other. The first and second lid segments each include an outer edge and an inner edge spaced in an opposing relationship. The inner edge of the first lid segment and the inner edge of the second lid segment are configured to face each other. The first lid segment includes a first locking feature disposed proximal to the inner edge of the first lid segment and the second lid segment includes a second locking feature disposed proximal to the inner edge of the second lid segment. The first and second lid segments are movable between an engaged position in which the first and second locking features engage each other to secure the first and second lid segments together to define a complete lid, and a disengaged position in which the first and second locking features disengage from each other to separate the first and second lid segments.

The detailed description and the drawings or Figures are supportive and descriptive of the disclosure, but the claim scope of the disclosure is defined solely by the claims. While some of the best modes and other embodiments for carrying out the claims have been described in detail, various alternative designs and embodiments exist for practicing the disclosure defined in the appended claims.

DETAILED DESCRIPTION

Those having ordinary skill in the art will recognize that terms such as "above", "below", "upward", "up", "downward", "down", "top", "bottom", "left", "right", "back", "forth", etc., are used descriptively for the figures, and do not represent limitations on the scope of the disclosure, as defined by the appended claims. Furthermore, the term "substantially" can refer to a slight imprecision or slight variance of a condition, quantity, value, or dimension, etc., some of which that are within manufacturing variance or tolerance ranges.

Figure 1:
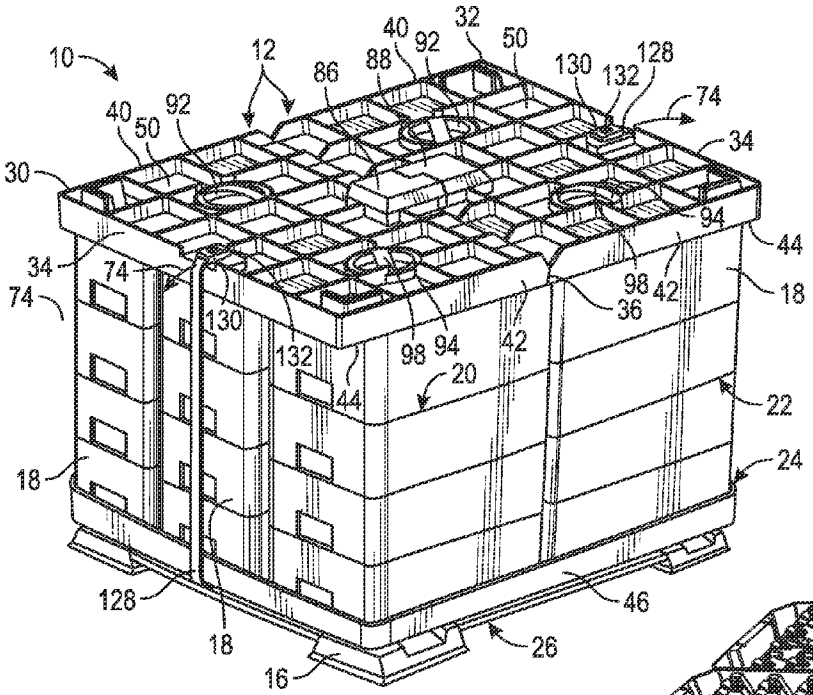
FIG. 1 is a schematic perspective view of a pallet assembly and a lid apparatus.

Referring to the Figures, wherein like numerals indicate like or corresponding parts throughout the several views, a pallet assembly 10 and a lid apparatus 12 are generally shown in FIG. 1.

Figure 2:
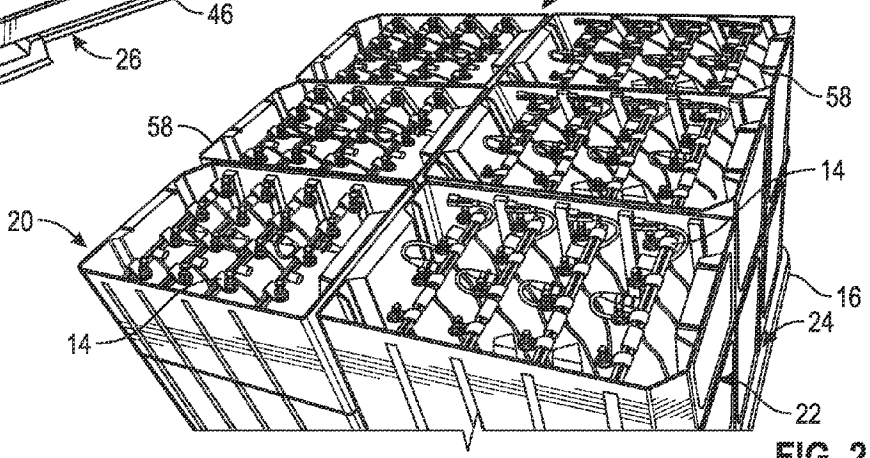
FIG. 2 is a schematic perspective view of a plurality of bins stacked on a base pallet, with the lid apparatus removed.

The pallet assembly 10 can be utilized to move, transport, ship or deliver various parts or components 14 (see FIG. 2). The components 14 can be vehicle components 14, non-vehicle components 14 or any other desired components 14 configured to cooperate with the pallet assembly 10 described herein.

Referring to FIG. 1, the pallet assembly 10 includes a base pallet 16 and at least one bin 18 or tray stacked on the base pallet 16. As best shown in FIG. 2, the bins 18 are designed to contain the components 14 and the bins 18 are open at a top 20 to move the components 14 in and out of the bins 18. In certain embodiments, a plurality of bins 18 are stacked on the base pallet 16 and the bins 18 can be stacked on top of each other on the base pallet 16. Therefore, the base pallet 16 supports the bins 18, and thus supports the components 14 disposed in the bins 18. The number of the bins 18 stacked on the base pallet 16 can depend on the size of the base pallet 16 and the size of the bins 18. Generally, when stacking a plurality of bins 18 on top of each other, a bottom 22 of one bin 18 closes the top 20 of another bin 18, and so on, until the desired number of bins 18 are stacked.

Figure 3:
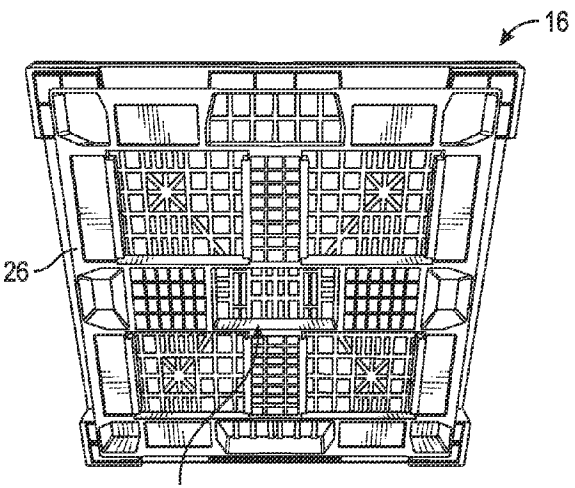
FIG. 3 is a schematic perspective view of a bottom side of the base pallet.

Continuing with FIG. 1, the base pallet 16 can include a top side 24 and a bottom side 26 opposing the top side 24. The bottom side 26 of the base pallet 16 is also shown in FIG. 3. Generally, the top side 24 faces upwardly and the bottom side 26 faces downwardly. Therefore, the bins 18 are stacked on the top side 24 of the base pallet 16.

Referring to FIG. 3, the bottom side 26 of the base pallet 16 can include a locating feature 28 for stacking another pallet assembly 10 on top of one pallet assembly 10. Therefore, a plurality of pallet assemblies 10 can be stacked on top of each other. As such, one bottom side 26 of one base pallet 16 of one pallet assembly 10 is stacked on one lid apparatus 12 of another pallet assembly 10, and so on until the desired number of pallet assemblies 10 are stacked on each other. The locating feature 28 can be any suitable configuration, and non-limiting examples are a protrusion, a boss, and/or a recess. The locating feature 28 is illustrated as the recess in FIG. 3. Therefore, the bottom side 26 of the base pallet 16 can define the recess and/or the protrusion, etc.

The pallet assembly 10 also includes the lid apparatus 12. As best shown in FIG. 1, generally, the lid apparatus 12 is disposed on top of the bin(s) 18. Therefore, the bin(s) 18 are disposed between the base pallet 16 and the lid apparatus 12. The base pallet 16 and the lid apparatus 12 cooperate to provide compact shipment of the components 14 in the bin(s) 18.

Figure 4:
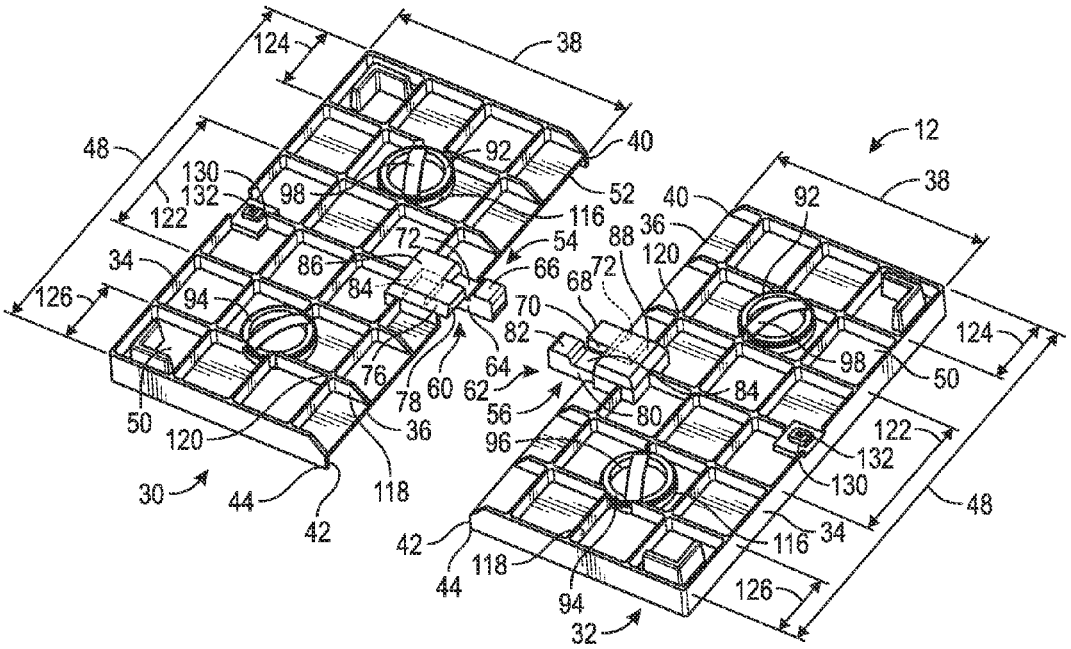
FIG. 4 is a schematic partial exploded perspective view of the lid apparatus, with a first lid segment and a second lid segment in a disengaged position.
Figure 11:
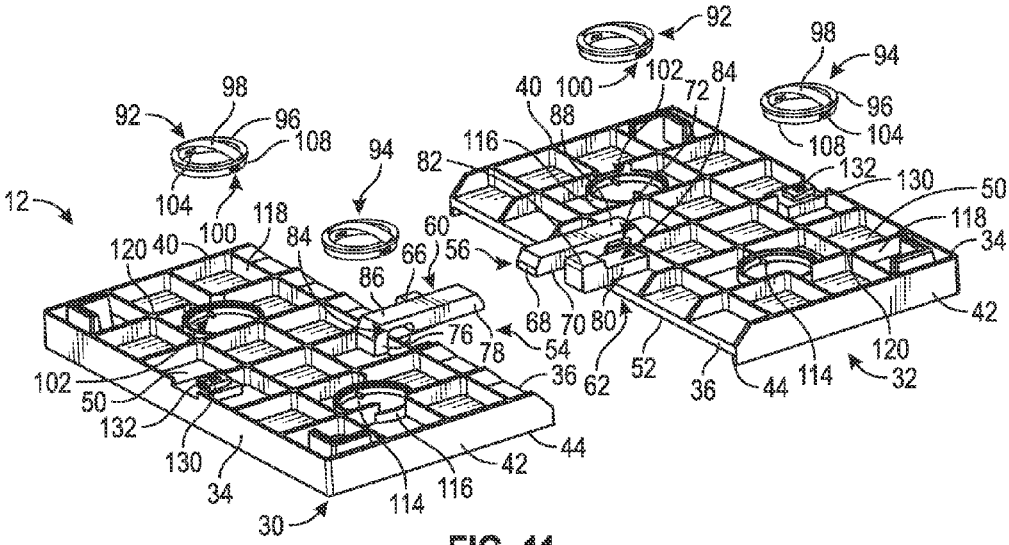
FIG. 11 is a schematic exploded view of the lid apparatus, with a slightly different configuration of the boss.

Continuing with FIGS. 1, 4 and 11, the lid apparatus 12 includes a first lid segment 30 and a second lid segment 32 selectively cooperating with each other. As best shown in FIGS. 4 and 11, the configuration/features of the first and second lid segments 30, 32 are substantially the same or substantially identical. Therefore, since the segments 30, 32 are substantially the same, prior to being stacked on the bin(s) 18 or when being removed from the bin(s) 18, the segments 30, 32 can be stacked in a row on top of each other which can reduce the amount of work space, and eliminates having to determine which segment 30, 32 goes with another segment 30, 32.

Generally, a molding process is utilized to form the segments 30, 32. Since the segments 30, 32 are configured the same, only one segment 30, 32 of the lid apparatus 12 is created by the molding process. Therefore, the molding machine is set up to form one lid segment 30, 32 since the segments 30, 32 are the same which reduces set up time and tooling costs of the molding machine, and also reduces the amount of space needed for the molding machine. Furthermore, the amount of space needed to store the segments 30, 32 created by the molding process is reduced since the segments 30, 32 are the same, and thus, can be stacked on top of each other. The segments 30, 32 can be formed by injection molding which provides rigidity to the segments 30, 32 and assists in preventing deflection of the first and second lid segments 30, 32 away from the top bin(s) 18. When the molding process is injection molding, the segments 30, 32 can be formed of a polymer. As one non-limiting example, the polymer can be polypropylene.

As best shown in FIGS. 4 and 11, the first and second lid segments 30, 32 each include an outer edge 34 and an inner edge 36 spaced in an opposing relationship. In certain embodiments, the outer and inner edges 34, 36 of respective first and second lid segments 30, 32 are substantially parallel to each other. The inner edge 36 of the first lid segment 30 and the inner edge 36 of the second lid segment 32 are configured to face each other (see FIGS. 1 and 4-7). The outer and inner edges 34, 36 of the respective first and second lid segments 30, 32 are spaced from each other a first length 38 (see FIG. 4).

Continuing with FIGS. 4 and 11, the first and second lid segments 30, 32 can each include a first side edge 40 and a second side edge 42 spaced from each other. In certain embodiments, the first and second side edges 40, 42 of respective first and second lid segments 30, 32 are substantially parallel to each other. The first and second side edges 40, 42 cooperate with the respective outer and inner edges 34, 36 of the first and second lid segments 30, 32 to present a periphery. For example, as shown in FIG. 4, in certain embodiments, the periphery of the first lid segment 30 defines a generally rectangular configuration and the periphery of the second lid segment 32 defines a generally rectangular configuration. Therefore, in certain embodiments, the outer and inner edges 34, 36 are substantially perpendicular to the first and second side edges 40, 42 of respective first and second lid segments 30, 32.

Optionally, the first and second side edges 40, 42 and the outer edge 34 of the first and second lid segments 30, 32 can each include a collar 44 (see FIGS. 1, 4 and 11) that partially surrounds the top bin(s) 18 when disposed thereon. The collar 44 of the first and second lid segments 30, 32 can minimize any fluids and/or contaminates from entering the top bin(s) 18. Furthermore, optionally, the base pallet 16 can include a collar 46 (see FIG. 1) which surrounds the bottom 22 of the bin(s) 18 that are stacked directly on the top side 24 of the base pallet 16 to assist in retaining those bin(s) 18 on top of the base pallet 16.

Turning to FIG. 4, the first and second side edges 40, 42 of the respective first and second lid segments 30, 32 are spaced from each other a second length 48. In certain embodiments, the first length 38 of the first and second lid segments 30, 32 is less than the respective second length 48 of the first and second lid segments 30, 32. For example, in certain embodiments, the second length 48 of each of the first and second lid segments 30, 32 is at least one-third of the length of the first length 38 of respective first and second lid segments 30, 32.

The first and second lid segments 30, 32 can each include a top surface 50 (see FIG. 4) and a bottom surface 52 (see FIGS. 6 and 7) opposing the respective top surface 50. In certain embodiments, the bottom surface 52 of each of the first and second lid segments 30, 32 defines a generally flat configuration (see FIGS. 6 and 7). The bottom surface 52 is configured to face the top bins 18 and is configured to selectively cooperate with the top bins 18. Therefore, the generally flat configuration of the bottom surface 52 is utilized to eliminate the need for the insert as discussed in the background section above and/or eliminate the need for the empty top bins as discussed in the background section above. The lid apparatus 12, and more specifically, the bottom surface 52 of the first and second lid segments 30, 32 close the top 20 of the top bin(s) 18 and assist in maintaining or restraining the position of the components 14 inside those top bin(s) 18. The flat configuration of the bottom surface 52 of the lid segments 30, 32 provides a universal lid that can be utilized with many different components 14. Optionally, one or more inserts can be attached to the bottom surface 52 of the segments 30, 32.

Figure 10:
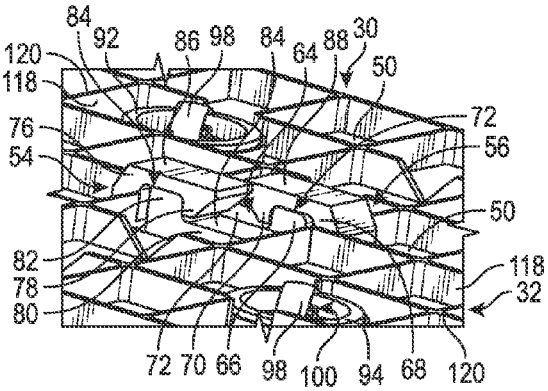
FIG. 10 is a schematic fragmentary perspective view of the first and second lid segments, with a slightly different configuration of the boss.

As best shown in FIGS. 4 and 10, the first lid segment 30 includes a first locking feature 54 disposed proximal to the inner edge 36 of the first lid segment 30 and the second lid segment 32 includes a second locking feature 56 disposed proximal to the inner edge 36 of the second lid segment 32. The first and second lid segments 30, 32 are movable between an engaged position in which the first and second locking features 54, 56 engage each other to secure the first and second lid segments 30, 32 together to define a complete lid, and a disengaged position in which the first and second locking features 54, 56 disengage from each other to separate the first and second lid segments 30, 32. When it is desirable to cover the top bin(s) 18 with the complete lid or whole lid, the first and second lid segments 30, 32 are moved to the engaged position on top of the bin(s) 18 (see FIG. 1). The engaged position is shown in FIGS. 1, 5, 7 and 10. When it is desirable to remove the complete lid or whole lid from the top bin(s) 18, the first and second lid segments 30, 32 are moved to the disengaged position and removed from the top bin(s) 18 (see FIG. 2). The disengaged position is shown in FIGS. 4 and 11.

Generally, once the desired number of bin(s) 18 are stacked on the base pallet 16, the lid apparatus 12 is then disposed on the top bin(s) 18. Therefore, to cover the open top of the top bin(s) 18, the first and second lid segments 30, 32 are disposed on the top bin(s) 18 in the engaged position. Referring to FIG. 2, the bin(s) 18 can include an upper edge 58 which can abut the bottom surface 52 of at least one of the first and second lid segments 30, 32 when in the engaged position. Depending on the number of bins 18 being utilized, the upper edge 58 of some of the bins 18 abut the bottom 22 of other bins 18, while the bins 18 at the top 20 are open so the first and second lid segments 30, 32 can be disposed over these top bins 18 to close the top bins 18. When moving the first and second lid segments 30, 32 to the engaged position, one of the first and second lid segments 30, 32 is disposed on the top bin(s) 18 and then the other one of the first and second lid segments 30, 32 is disposed on the top bin(s) 18, with the first and second locking features 54, 56 engaging each other to define the complete lid.

The first locking feature 54 of FIGS. 4, 10 and 11 is disposed along a middle portion 60 of the inner edge 36 of the first lid segment 30 relative to the second length 48 of the first lid segment 30. The second locking feature 56 of FIGS. 4, 10 and 11 is also disposed along a middle portion 62 of the inner edge 36 of the second lid segment 32 relative to the second length 48 of the second lid segment 32. In other words, the first and second locking features 54, 56 are spaced from the first and second side edges 40, 42 of respective first and second lid segments 30, 32 generally proximal to a center of respective inner edges 36. By positioning the first and second locking features 54, 56 only at respective middle portions 60, 62, this provides quick and ergonomic attachment/detachment of the first and second lid segments 30, 32.

As best shown in FIGS. 4, 10 and 11, the first locking feature 54 can include a first finger 64 having a first protrusion 66 extending outwardly therefrom and the second locking feature 56 can include a first finger 68 having a first protrusion 70 extending outwardly therefrom. Therefore, behind the respective first protrusions 66, 70 a first depression 72 is created in the respective first fingers 64, 68. The first and second locking features 54, 56 at least partially overlap each other such that the first protrusion 66, 70 of the first and second locking features 54, 56 engage each other to secure the first and second lid segments 30, 32 together when in the engaged position (see FIG. 10). Therefore, at least a portion of each of the first protrusions 66, 70 overlap each other when in the engaged position. As such, the first protrusion 66 of the first locking feature 54 is disposed in the first depression 72 of the second locking feature 56 when in the engaged position, and the first protrusion 70 of the second locking feature 56 is disposed in the first depression 72 of the first locking feature 54 when in the engaged position. Having the first protrusions 66, 70 overlap or be disposed in respective first depressions 72 when in the engaged position prevents the first and second lid segments 30, 32 from separating when an opposing force 74 (represented by arrows 74 in FIG. 1) is applied to the first and second lid segments 30, 32.

Continuing with FIGS. 4, 10 and 11, in certain embodiments, the first locking feature 54 can include a second finger 76 having a second protrusion 78 extending outwardly therefrom and the second locking feature 56 can include a second finger 80 having a second protrusion 82 extending outwardly therefrom. Therefore, behind the respective second protrusions 78, 82 a second depression 84 is created in the respective second fingers 76, 80. The first and second locking features 54, 56 at least partially overlap each other such that the second protrusion 78, 82 of the first and second locking features 54, 56 engage each other to secure the first and second lid segments 30, 32 together when in the engaged position (see FIG. 10). Therefore, at least a portion of each of the second protrusions 78, 82 overlap each other when in the engaged position. As such, the second protrusion 78 of the first locking feature 54 is disposed in the second depression 84 of the second locking feature 56 when in the engaged position, and the second protrusion 82 of the second locking feature 56 is disposed in the second depression 84 of the first locking feature 54 when in the engaged position. Having the second protrusions 78, 82 overlap or be disposed in respective second depressions 84 when in the engaged position prevents the first and second lid segments 30, 32 from separating when the opposing force 74 (see FIG. 1) is applied to the first and second lid segments 30, 32.

As best shown in FIGS. 4, 10 and 11, the first and second fingers 64, 76 of the first locking feature 54 are disposed adjacent to each other. Generally, the first protrusion 66 of the first locking feature 54 faces outwardly away from the top surface 50 of the first lid segment 30. Simply stated, the first protrusion 66 of the first locking feature 54 faces upwardly. Furthermore, the second protrusion 78 of the first locking feature 54 faces outwardly toward the top surface 50 of the first lid segment 30. Simply stated, the second protrusion 78 of the first locking feature 54 faces downwardly. As such, the first and second protrusions 66, 78 of the first locking feature 54 extend in opposite directions.

Continuing with FIGS. 4, 10 and 11, similarly, the first and second fingers 68, 80 of the second locking feature 56 are disposed adjacent to each other. Generally, the second protrusion 82 of the second locking feature 56 faces outwardly away from the top surface 50 of the second lid segment 32. Simply stated, the second protrusion 82 of the second locking feature 56 faces upwardly. Furthermore, the first protrusion 70 of the second locking feature 56 faces outwardly toward the top surface 50 of the second lid segment 32. Simply stated, the first protrusion 70 of the second locking feature 56 faces downwardly. As such, the first and second protrusions 70, 82 of the second locking feature 56 extend in opposite directions.

Figure 5:
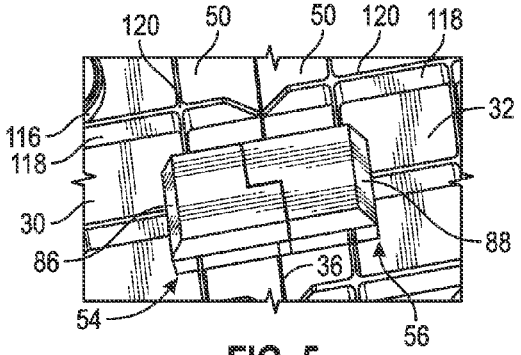
FIG. 5 is a schematic fragmentary perspective view of the first and second lid segments in an engaged position, with a first locking feature and a second locking feature cooperating to present a boss.
Figure 6:
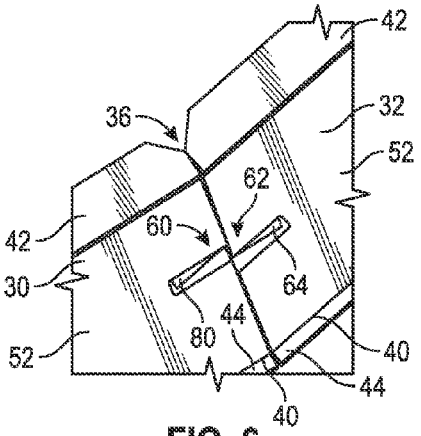
FIG. 6 is a schematic fragmentary perspective view of a bottom surface of the first and second lid segments, with the second lid segment disposed on an angle relative to the first lid segment when moving toward the engaged position.
Figure 7:
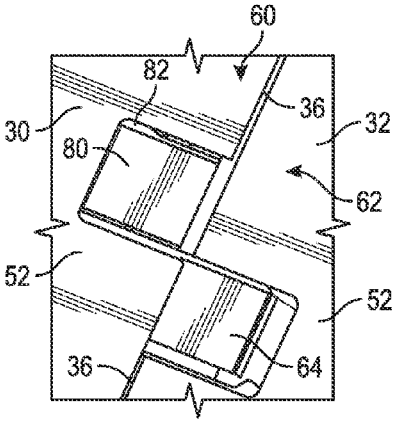
FIG. 7 is a schematic fragmentary perspective view of the bottom surface of the first and second lid segments, with the first and second lid segments in the engaged position.

As best shown in FIG. 5, in certain embodiments, the first locking feature 54 can include a first positioning feature 86 facing outwardly away from the top surface 50 of the first lid segment 30. In other words, the first positioning feature 86 faces upwardly. Additionally, the second locking feature 56 can include a second positioning feature 88 facing outwardly away from the top surface 50 of the second lid segment 32. In other words, the second positioning feature 88 faces upwardly. The first and second positioning features 86, 88 cooperate to present a boss when the first and second lid segments 30, 32 are in the engaged position. The boss provides a positioning feature for stacking another pallet assembly 10 on top of the lid apparatus 12 of the bottom 22 pallet assembly 10. FIG. 5 illustrates the first and second positioning features 86, 88 of FIG. 4 when the first and second lid segments 30, 32 are in the engaged position. FIGS. 4, 10 and 11 illustrate slightly different configurations of the first and second positioning features 86, 88.

The first and second positioning features 86, 88 cooperate with the bottom side 26 of another base pallet 16 of another pallet assembly 10. Specifically, the boss of one lid apparatus 12 cooperates with the locating feature 28 of another base pallet 16 of another pallet assembly 10. In one example, the first and second positioning features 86, 88 of one lid apparatus 12 are disposed in the recess of another base pallet 16 which positions the lid apparatus 12 and that base pallet 16 relative to each other. Furthermore, when the first and second positioning features 86, 88 of one lid apparatus 12 are disposed in the recess of another base pallet 16, the recess of that base pallet 16 can also restrain movement of the boss of the lid apparatus 12. By positioning the first and second locking features 54, 56 generally at the respective middle portion 60, 62 of the inner edge 36 of the respective first and second lid segments 30, 32, the first and second positioning features 86, 88 that create the boss can also be disposed at the middle portions 60, 62 to cooperate with existing base pallet designs. As such, a new base pallet design does not need to be created to cooperate with the lid apparatus 12 discussed herein.

Figure 9:
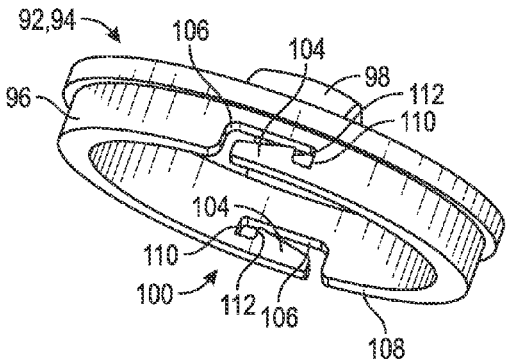
FIG. 9 is a schematic perspective view of a handle.

Turning to FIGS. 4, 9 and 11, the first and second lid segments 30, 32 can include at least one grip feature that allow the segments 30, 32 to be easily moved between the engaged and disengaged positions. Generally, in certain embodiments, the grip feature is formed of a non-metallic material that minimizes oxidation of the grip feature. For example, the first and second lid segments 30, 32 can each include a first handle 92 and a second handle 94 coupled to the respective top surface 50 of the first and second lid segments 30, 32 for moving the respective first and second lid segments 30, 32 between the engaged and disengaged positions. The first and second handles 92, 94 of the first lid segment 30 are spaced from each other. The first and second handles 92, 94 of the second lid segment 32 are spaced from each other. The grip feature can be defined as the first and second handles 92, 94 or any other suitable handles, grips, handholds, etc. to move the first and second lid segments 30, 32. The first and second handles 92, 94 are coupled to the first and second lid segments 30, 32 without creating through-holes in the respective first and second lid segments 30, 32 which minimizes any fluids and/or contaminates from entering the bins 18 therethrough. The handles 92, 94 can be formed of a polymer or any other suitable material.

As best shown in FIGS. 4 and 11, the first and second handles 92, 94 of the first and second lid segments 30, 32 can each include a ring 96 and a band 98 extending across the ring 96. The ring 96 and the band 98 of each of the handles 92, 94 cooperate to provide a space for gripping the respective handle 92, 94. Generally, an operator grasps the band 98 to move the handles 92, 94.

The first and second handles 92, 94 of the first and second lid segments 30, 32 can each include a first retaining feature 100 (see FIGS. 9 and 11). The first and second handles 92, 94 of the first and second lid segments 30, 32 can each include a second retaining feature 102 (see FIGS. 8 and 11). The first and second retaining features 100, 102 cooperate to secure the handles 92, 94 to the respective lid segments 30, 32. The first and second retaining features 100, 102 can be any suitable configuration and a plurality of first and second retaining features 100, 102 can be utilized. One non-limiting example of the first and second retaining features 100, 102 is discussed below.

The first retaining feature 100 of each of the handles 92, 94 can be coupled to the ring 96 of respective first and second handles 92, 94. The first retaining feature 100 can be coupled to the ring 96 of respective first and second handles 92, 94 by fasteners, molding, welding, adhesive, formed by machining or cutting, formed as one piece, etc.

As best shown in FIG. 9, the first retaining feature 100 of the first and second handles 92, 94 can be at least one tab 104. In certain embodiments, the tab 104 is defined as a plurality of tabs 104. Each of the tabs 104 can be coupled to the ring 96 of respective first and second handles 92, 94 and engage with respective second retaining features 102. The ring 96 of the first and second handles 92, 94 can each define a channel 106 which forms the respective tabs 104. Therefore, the respective tabs 104 extend partially into the respective channel 106 to retain the second retaining feature 102. The respective second retaining feature 102 moves through the respective channel 106 and engages the respective tab 104 to secure the handles 92, 94 to the respective first and second lid segments 30, 32.

In certain embodiments, each channel 106 is open to a bottom edge 108 (see FIG. 9) of the respective ring 96 such that the respective second retaining feature 102 can enter the respective channel 106. The respective channels 106 can each extend to an end wall 110 which prevents further movement of the respective second retaining features 102 into the channel 106, and therefore, the end wall 110 acts as a stop.

Each tab 104 can include a front wall 112 spaced from and facing the end wall 110 which restricts movement of the respective second retaining features 102 back out of the channel 106. Therefore, once the respective second retaining features 102 are disposed in the respective channel 106 between the front and end walls 112, 110, the respective handle 92, 94 is secured to the respective lid segment 30, 32.

Figure 8:
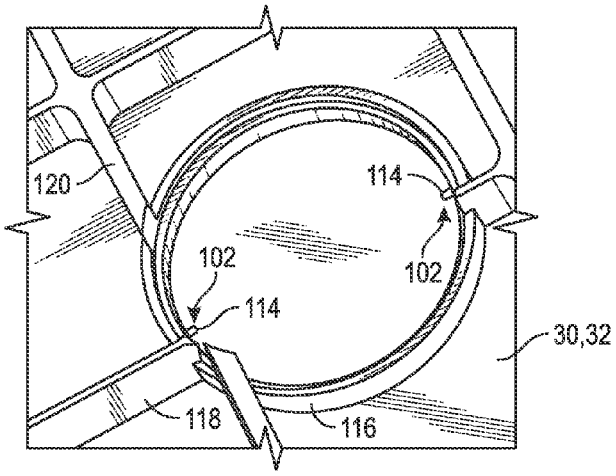
FIG. 8 is a schematic fragmentary perspective view of a top surface of one of the first and second lid segments.

As best shown in FIG. 8, the second retaining feature 102 of the first and second lid segments 30, 32 can be at least one projection 114. In certain embodiments, the projection 114 is defined as a plurality of projections 114. Each of the projections 114 can extend from the respective first and second lid segments 30, 32 and engage with respective first retaining features 100, such as the tabs 104. The projection(s) 114 of the first and second lid segments 30, 32 can each move through the respective channel 106 and engage the respective tab 104 to secure the handles 92, 94 to the respective first and second lid segments 30, 32.

As best shown in FIGS. 8 and 11, the first and second lid segments 30, 32 can each include a plurality of flanges 116 extending outwardly from the respective top surface 50 away from the respective bottom surface 52. Therefore, the first and second handles 92, 94 of the first lid segment 30 can be coupled to respective flanges 116 of the first lid segment 30, and the first and second handles 92, 94 of the second lid segment 32 can be coupled to respective flanges 116 of the second lid segment 32. For example, the ring 96 of one of the first handles 92 can be at least partially disposed inside one of the flanges 116 (see FIGS. 4 and 10), and the ring 96 of one of the second handles 94 can be at least partially disposed inside another one of the flanges 116, and so on. Generally, the flanges 116 at least partially surround the ring 96 of respective first and second handles 92, 94. The second retaining feature 102 can extend from the flanges 116 as best shown in FIG. 8. The second retaining feature 102 can extend from the respective first and second lid segments 30, 32 in any suitable orientation and location, and FIG. 8 is only illustrative.

When initially securing the first handle 92 to the first lid segment 30, the second retaining feature 102, such as the projection 114 is inserted into the channel 106 and then the first handle 92 is rotated, either clockwise or counter clockwise depending on the direction of the channel 106. The first handle 92 is rotated until the projection 114 passes the tab 104 in which the projection 114 will be disposed between the front wall 112 and the end wall 110. If the projection 114 engages the end wall 110, no further rotation of the first handle 92 will occur because the end wall 110 acts as a stop. Once the first handle 92 is secured to the first lid segment 30, the first handle 92 can remain secured to the first lid segment 30 for the remainder of its life. If the first handle 92 needs to be replaced, the first handle 92 can be rotated in the opposite direction back through the channel 106 pass the tab 104 and out of the channel 106, and then another first handle 92 can be secured to the first lid segment 30. The same procedure discussed immediately above applies to the second handle 94 of the first lid segment 30 and the other handles 92, 94 of the second lid segment 32, and will not be repeated.

Generally, the second retaining feature 102 of the first lid segment 30 is integrally formed to each other to eliminate through-holes in the first lid segment 30 that can introduce fluids and/or contaminates into the bins 18. Similarly, the second retaining feature 102 of the second lid segment 32 is integrally formed to each other to eliminate through-holes in the second lid segment 32 that can introduce fluids and/or contaminates into the bins 18. Therefore, the top surface 50 of each of the first and second lid segments 30, 32 are formed without through-holes for the respective first and second handles 92, 94 which minimizes any fluids and/or contaminates from entering the bins 18 therethrough. The second retaining feature 102 of the first lid segment 30 can be molded, machined, cut, adhered, formed as one piece, etc. Similarly, the second retaining feature 102 of the second lid segment 32 can be molded, machined, cut, adhered, formed as one piece, etc.

In certain embodiments, the top surface 50 of each of the first and second lid segments 30, 32 can also include a plurality of ribs 118 extending outwardly away from the respective bottom surface 52 to a distal end 120. The ribs 118 can provide strength and/or rigidity to the first and second lid segments 30, 32. Some of the ribs 118 are disposed adjacent to the flanges 116. The ribs 118 are only disposed on the top surface 50 of the first and second lid segments 30, 32 which allows the bottom surface 52 of these segments 30, 32 to be configured as the generally flat configuration.

Referring to FIGS. 1 and 10, the first and second handles 92, 94 of the first lid segment 30 can be disposed at a height that is equal to or less than the distal end 120 of the ribs 118 of the first lid segment 30. Therefore, the first and second handles 92, 94 of the first lid segment 30 are flush with the distal end 120 of the ribs 118 or recessed below the distal end 120 of the ribs 118.

Furthermore, the first and second handles 92, 94 of the second lid segment 32 can be disposed at a height that is equal to or less than the distal end 120 of the ribs 118 of the second lid segment 32. Therefore, the first and second handles 92, 94 of the second lid segment 32 are flush with the distal end 120 of the ribs 118 or recessed below the distal end 120 of the ribs 118. As such, when the base pallet 16 of another pallet assembly 10 is stacked on the lid apparatus 12, the first and second handles 92, 94 do not interfere with the positioning of another base pallet 16 on the boss of the lid apparatus 12.

The first and second handles 92, 94 of the first and second lid segments 30, 32 are positioned for ergonomic purposes. Therefore, the handles 92, 94 are positioned to minimize the effort to lift and move the first and second lid segments 30, 32. The first and second handles 92, 94 of the first lid segment 30 are generally centered on the top surface 50 of the first lid segment 30 along the first length 38 of the first lid segment 30. Similarly, the first and second handles 92, 94 of the second lid segment 32 are generally centered on the top surface 50 of the second lid segment 32 along the first length 38 of the second lid segment 32.

Furthermore, referring to FIG. 4, the first and second handles 92, 94 of the respective first and second lid segments 30, 32 are spaced a first distance 122 from each other along the second length 48 of the respective first and second lid segments 30, 32. The first handle 92 of the first and second lid segments 30, 32 is spaced a second distance 124 from the first side edge 40 of the respective first and second lid segments 30, 32 along the second length 48 of the respective first and second lid segments 30, 32. The second handle 94 of the respective first and second lid segments 30, 32 is spaced a third distance 126 from the second side edge 42 of the respective first and second lid segments 30, 32 along the second length 48 of the respective first and second lid segments 30, 32. The second and third distances 124, 126 are substantially equal to each other, and the first distance 122 is greater than the second and third distances 124, 126.

When the first and second lid segments 30, 32 are disposed in the engaged position on the bin(s) 18, the complete lid can define a size of approximately 48 inches by 45 inches. Therefore, each of the lid segments 30, 32 can define a size of approximately 24 inches by 45 inches. By splitting the complete lid into two lid segments 30, 32, the pieces are more ergonomic to move and handle, and the center of gravity of the segments 30, 32 are closer to the operator which also assists in making the pieces more ergonomic to move and handle. Furthermore, with each lid segment 30, 32 having two handles 92, 94 located as discussed above, the lid segments 30, 32 are more ergonomic to move and handle. The operator reaches for the first and second handles 92, 94 of the first lid segment 30 from the outer edge 34 of the first lid segment 30. Similarly, the operator reaches for the first and second handles 92, 94 of the second lid segment 32 from the outer edge 34 of the second lid segment 32. Therefore, in certain embodiments, due to the location of the first and second handles 92, 94, when the lid segments 30, 32 are approximately 24 inches by 45 inches, the operator is reaching approximately 10-14 inches from the outer edge 34, which makes the segments 30, 32 more ergonomic to move because the mass of the segments 30, 32, and thus the center of gravity of the segments 30, 32, are closer to the operator. It is to be appreciated for other sizes of the lid segments 30, 32, the distance the operator reaches can correspondingly change.

Generally, as discussed above, one lid segment 30, 32 is placed along the top 20 of the open top bin(s) 18 and then the other lid segment 30, 32 is positioned to engage the lid segment 30, 32 already positioned on the top bin(s) 18. For example, if the first lid segment 30 is placed on the top bin(s) 18, the bottom surface 52 of this lid segment 30 is disposed substantially flat along the top bin(s) 18, the second lid segment 32 can be positioned or slid along the top 20 of the open top bin(s) 18 and the inner edge 36 of the second lid segment 32 can be disposed at an angle (see FIG. 6) relative to the inner edge 36 of the first lid segment 30, this allows the respective first and second protrusions 66, 70, 78, 82 to pass each other and interlock as the second lid segment 32 is rotated down such that the bottom surface 52 of this lid segment 32 is disposed substantially flat along the top bin(s) 18.

As shown in FIG. 1, the lid apparatus 12 can be coupled to the base pallet 16. Specifically, the pallet assembly 10 can include a plurality of belts 128, each being retractable, and a plurality of buckles 130, with one buckle 130 selectively cooperating with one belt 128. Generally, one end of each of the belts 128 is fixed relative to the base pallet 16 and the other end of each of the belts 128 can selectively cooperate with respective buckles 130.

Therefore, the belts 128 can each include a latch that selectively engages the respective buckles 130 to couple the base pallet 16 and the lid apparatus 12 together. The buckles 130 can each include a release 132 to selectively release 132 the respective latch which allows the respective belts 128 to retract toward the fixed end. The respective belts 128 are fully retracted when the respective latch is disposed adjacent to the base pallet 16. The latch and the release 132 can be any suitable configuration.

As shown in FIG. 1, one of the buckles 130 is secured to the first lid segment 30 and the other one of the buckles 130 is secured to the second lid segment 32. Generally, the buckles 130 oppose each other on opposite sides 24, 26 of the first and second lid segments 30, 32. For example, one of the buckles 130 can be exposed on the top surface 50 of the first lid segment 30 and disposed adjacent to the outer edge 34 of the first lid segment 30. Furthermore, the other one of the buckles 130 can be exposed on top of the top surface 50 of the second lid segment 32 and disposed adjacent to the outer edge 34 of the second lid segment 32. In one embodiment, the buckles 130 are generally centered along the outer edge 34 of respective first and second lid segments 30, 32 such that the buckles 130 generally oppose each other. Optionally, the buckles 130 can be disposed flush with or recessed below the distal end 120 of the ribs 118 of the respective first and second lid segments 30, 32. As such, when the base pallet 16 of another pallet assembly 10 is stacked on the lid apparatus 12, the buckles 130 do not interfere with the positioning that base pallet 16 on the boss of the lid apparatus 12.

The location of the fixed end of each of the belts 128 are positioned in accordance to the location of the respective buckles 130. For example, if the buckles 130 are generally centered along the outer edge 34, the fixed end of the belts 128 are generally centered between two respective ends of the base pallet 16. Since the lid segments 30, 32 are selectively disposed on the top bin(s) 18, the operator will have to position each of the lid segments 30, 32 in accordance with the sides of the base pallet 16 where the latches are disposed.

To maintain the position of the lid apparatus 12 relative to the top bin(s) 18, the belts 128 are secured to the buckles 130. When the belts 128 are secured to the buckles 130, the opposing force 74 is applied to the lid apparatus 12 which cinches the lid apparatus 12 to the bin(s) 18. With the lid apparatus 12 being cinched down, the features of the lid apparatus 12 discussed above allow the bottom surface 52 of the first and second lid segments 30, 32 to remain flush relative to the upper edge 58 of the top bin(s) 18, thus assisting in maintaining or restraining the position of the components 14 in those bin(s) 18. Furthermore, the first and second locking features 54, 56 are designed to remain locked together when the opposing force 74 is applied to the lid apparatus 12 and prevent deflection of the first and second lid segments 30, 32 outwardly away from the top bin(s) 18. By minimizing deflection, the bottom surface 52 of the first and second lid segments 30, 32 remain flush relative to the upper edge 58 of the top bin(s) 18, thus assisting in maintaining or restraining the position of the components 14 in those bin(s) 18.

While the best modes for carrying out the disclosure have been described in detail, those familiar with the art to which this disclosure relates will recognize various alternative designs and embodiments for practicing the disclosure within the scope of the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A lid apparatus for a pallet assembly, the apparatus comprising:

a first lid segment and a second lid segment selectively cooperating with each other;

wherein the first and second lid segments each include an outer edge and an inner edge spaced in an opposing relationship, with the inner edge of the first lid segment and the inner edge of the second lid segment configured to face each other;

wherein the first lid segment includes a first locking feature disposed proximal to the inner edge of the first lid segment; and wherein the second lid segment includes a second locking feature disposed proximal to the inner edge of the second lid segment, with the first and second lid segments being movable between an engaged position in which the first and second locking features engage each other to secure the first and second lid segments together to define a complete lid, and a disengaged position in which the first and second locking features disengage from each other to separate the first and second lid segments.

2. The apparatus as set forth in claim 1 wherein:

the first locking feature includes a first finger having a first protrusion extending outwardly therefrom;

the second locking feature includes a first finger having a first protrusion extending outwardly therefrom; and the first and second locking features at least partially overlap each other such that the first protrusion of the first locking feature and the first protrusion of the second locking feature engage each other to secure the first and second lid segments together when in the engaged position.

3. The apparatus as set forth in claim 2 wherein:

the first locking feature includes a second finger having a second protrusion extending outwardly therefrom;

the second locking feature includes a second finger having a second protrusion extending outwardly therefrom; and the first and second locking features at least partially overlap each other such that the second protrusion of the first and second locking features engage each other to secure the first and second lid segments together when in the engaged position.

4. The apparatus as set forth in claim 3 wherein:

the first and second fingers of the first locking feature are disposed adjacent to each other, and the first protrusion of the first locking feature faces outwardly away from a top surface of the first lid segment and the second protrusion of the first locking feature faces outwardly toward the top surface of the first lid segment such that the first and second protrusions of the first locking feature extend in opposite directions; and the first and second fingers of the second locking feature are disposed adjacent to each other, and the first protrusion of the second locking feature faces outwardly away from a top surface of the second lid segment and the second protrusion of the second locking feature faces outwardly toward the top surface of the second lid segment such that the first and second protrusions of the second locking feature extend in opposite directions.

5. The apparatus as set forth in claim 1 wherein:

the first and second lid segments each include a top surface and a bottom surface opposing the respective top surface, with the bottom surface of each of the first and second lid segments defining a generally flat configuration;

the first locking feature includes a first positioning feature extending outwardly away from the top surface of the first lid segment; and the second locking feature includes a second positioning feature extending outwardly away from the top surface of the second lid segment, with the first and second positioning features cooperating to present a boss when the first and second lid segments are in the engaged position.

6. The apparatus as set forth in claim 1 wherein:

the first and second lid segments each include a top surface and a bottom surface opposing the respective top surface, with the bottom surface of each of the first and second lid segments defining a generally flat configuration; and the first and second lid segments each include a first handle and a second handle coupled to the respective top surface of the first and second lid segments for moving the respective first and second lid segments between the engaged and disengaged positions, with the first and second handles of the first lid segment being spaced from each other, and the first and second handles of the second lid segment being spaced from each other.

7. The apparatus as set forth in claim 6 wherein the first and second handles of the first and second lid segments each include a ring and a band extending across the ring.

8. The apparatus as set forth in claim 6 wherein the first and second lid segments each include a plurality of flanges extending outwardly from the respective top surface away from the respective bottom surface, with the first and second handles of the first lid segment coupled to respective flanges of the first lid segment, and the first and second handles of the second lid segment coupled to respective flanges of the second lid segment.

9. The apparatus as set forth in claim 6 wherein:

the top surface of each of the first and second lid segments include a plurality of ribs extending outwardly away from the respective bottom surface to a distal end; and the first and second handles of the first lid segment are disposed at a height that is equal to or less than the distal end of the ribs of the first lid segment, and the first and second handles of the second lid segment are disposed at a height that is equal to or less than the distal end of the ribs of the second lid segment.

10. The apparatus as set forth in claim 6 wherein:

the first and second lid segments each include a first side edge and a second side edge spaced from each other and cooperating with the respective outer and inner edges to present a periphery;

the outer and inner edges of the respective first and second lid segments are spaced from each other a first length, and the first and second side edges of the respective first and second lid segments are spaced from each other a second length, with the first length of the first and second lid segments being less than the respective second length of the first and second lid segments; and the first and second handles of the first lid segment are generally centered on the top surface of the first lid segment along the first length of the first lid segment, and the first and second handles of the second lid segment are generally centered on the top surface of the second lid segment along the first length of the second lid segment.

11. The apparatus as set forth in claim 10 wherein:

the first and second handles of the respective first and second lid segments are spaced a first distance from each other along the second length of the respective first and second lid segments;

the first handle of the first and second lid segments is spaced a second distance from the first side edge of the respective first and second lid segments along the second length of the respective first and second lid segments;

the second handle of the respective first and second lid segments is spaced a third distance from the second side edge of the respective first and second lid segments along the second length of the respective first and second lid segments; and the second and third distances substantially equal to each other, and the first distance is greater than the second and third distances.

12. The apparatus as set forth in claim 1 wherein:

the first and second lid segments each include a first side edge and a second side edge spaced from each other and cooperating with the respective outer and inner edges of the first and second lid segments to present a periphery;

the outer and inner edges of the respective first and second lid segments are spaced from each other a first length, and the first and second side edges of the respective first and second lid segments are spaced from each other a second length, with the first length of the first and second lid segments being less than the respective second length of the first and second lid segments; and the first locking feature is generally centered along the inner edge of the first lid segment relative to the second length of the first lid segment, and the second locking feature is generally centered along the inner edge of the second lid segment relative to the second length of the second lid segment.

13. A pallet assembly comprising:

a base pallet;

at least one bin stacked on the base pallet;

a lid apparatus disposed on top of the at least one bin, with the lid apparatus including:

a first lid segment and a second lid segment selectively cooperating with each other;

wherein the first and second lid segments each include an outer edge and an inner edge spaced in an opposing relationship, with the inner edge of the first lid segment and the inner edge of the second lid segment configured to face each other;

wherein the first lid segment includes a first locking feature disposed proximal to the inner edge of the first lid segment; and wherein the second lid segment includes a second locking feature disposed proximal to the inner edge of the second lid segment, with the first and second lid segments being movable between an engaged position in which the first and second locking features engage each other to secure the first and second lid segments together to define a complete lid, and a disengaged position in which the first and second locking features disengage from each other to separate the first and second lid segments.

14. The assembly as set forth in claim 13 wherein:

the first locking feature includes a first finger having a first protrusion extending outwardly therefrom;

the second locking feature includes a first finger having a first protrusion extending outwardly therefrom; and the first and second locking features at least partially overlap each other such that the first protrusion of the first locking feature and the first protrusion of the second locking feature engage each other to secure the first and second lid segments together when in the engaged position.

15. The assembly as set forth in claim 14 wherein:

the first locking feature includes a second finger having a second protrusion extending outwardly therefrom;

the second locking feature includes a second finger having a second protrusion extending outwardly therefrom; and the first and second locking features at least partially overlap each other such that the second protrusion of the first and second locking features engage each other to secure the first and second lid segments together when in the engaged position.

16. The assembly as set forth in claim 15 wherein:

the first and second fingers of the first locking feature are disposed adjacent to each other, and the first protrusion of the first locking feature faces outwardly away from a top surface of the first lid segment and the second protrusion of the first locking feature faces outwardly toward the top surface of the first lid segment such that the first and second protrusions of the first locking feature extend in opposite directions; and the first and second fingers of the second locking feature are disposed adjacent to each other, and the first protrusion of the second locking feature faces outwardly away from a top surface of the second lid segment and the second protrusion of the second locking feature faces outwardly toward the top surface of the second lid segment such that the first and second protrusions of the second locking feature extend in opposite directions.

17. The assembly as set forth in claim 13 wherein:

the first and second lid segments each include a top surface and a bottom surface opposing the respective top surface, with the bottom surface of each of the first and second lid segments defining a generally flat configuration; and the at least one bin includes an upper edge abutting the bottom surface of at least one of the first and second lid segments when in the engaged position.

18. The assembly as set forth in claim 13 wherein:

the first and second lid segments each include a top surface and a bottom surface opposing the respective top surface, with the bottom surface of each of the first and second lid segments defining a generally flat configuration;

the first locking feature includes a first positioning feature extending outwardly away from the top surface of the first lid segment; and the second locking feature includes a second positioning feature extending outwardly away from the top surface of the second lid segment, with the first and second positioning features cooperating to present a boss when the first and second lid segments are in the engaged position.

19. The assembly as set forth in claim 13 wherein:

the first and second lid segments each include a top surface and a bottom surface opposing the respective top surface, with the bottom surface of each of the first and second lid segments defining a generally flat configuration; and the first and second lid segments each include a first handle and a second handle coupled to the respective top surface of the first and second lid segments for moving the respective first and second lid segments between the engaged and disengaged positions, with the first and second handles of the first lid segment being spaced from each other, and the first and second handles of the second lid segment being spaced from each other.

20. The apparatus as set forth in claim 13 wherein:

the first and second lid segments each include a first side edge and a second side edge spaced from each other and cooperating with the respective outer and inner edges of the first and second lid segments to present a periphery;

the outer and inner edges of the respective first and second lid segments are spaced from each other a first length, and the first and second side edges of the respective first and second lid segments are spaced from each other a second length, with the first length of the first and second lid segments being less than the respective second length of the first and second lid segments; and the first locking feature is generally centered along the inner edge of the first lid segment relative to the second length of the first lid segment, and the second locking feature is generally centered along the inner edge of the second lid segment relative to the second length of the second lid segment.

* * * * *